US008424333B2

(12) United States Patent
Yoon et al.

(10) Patent No.: US 8,424,333 B2
(45) Date of Patent: Apr. 23, 2013

(54) AIR CONDITIONER

(75) Inventors: Pil Hyun Yoon, Changwon-si (KR); Hyun Ju Kwag, Changwon-si (KR); Seok Hoon Jang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 488 days.

(21) Appl. No.: 12/759,297

(22) Filed: Apr. 13, 2010

(65) Prior Publication Data

US 2011/0041541 A1 Feb. 24, 2011

(30) Foreign Application Priority Data

Aug. 19, 2009 (KR) ..... 10-2009-0076837

(51) Int. Cl.
*F25B 13/00* (2006.01)
*F25B 41/00* (2006.01)
*F25D 21/06* (2006.01)

(52) U.S. Cl.
USPC ..... 62/324.6; 62/324.1; 62/160; 62/197; 62/152; 62/81

(58) Field of Classification Search ..... 62/160, 62/324.1, 324.6, 196.4, 197, 151, 152, 81, 62/504
See application file for complete search history.

(56) References Cited

U.S. PATENT DOCUMENTS

| | | | | |
|---|---|---|---|---|
| 3,866,439 | A * | 2/1975 | Bussjager et al. | 62/504 |
| 4,407,137 | A * | 10/1983 | Hayes, Jr. | 62/80 |
| 5,694,782 | A * | 12/1997 | Alsenz | 62/156 |
| 7,171,817 | B2 * | 2/2007 | Birgen | 62/81 |
| 2005/0284174 | A1 * | 12/2005 | Nakajima | 62/513 |
| 2007/0137238 | A1 * | 6/2007 | Hu | 62/277 |
| 2010/0170270 | A1 * | 7/2010 | Jang et al. | 62/81 |

FOREIGN PATENT DOCUMENTS

CN 2874364 Y 2/2007

* cited by examiner

*Primary Examiner* — Frantz F. Jules
*Assistant Examiner* — Joseph Trpisovsky
(74) *Attorney, Agent, or Firm* — McKenna Long & Aldridge LLP

(57) ABSTRACT

An air conditioner is provided. The air conditioner includes: an outdoor heat exchange unit in which a plurality of refrigerant tubes are disposed to be separated in a plurality of columns in a vertical direction to exchange heat of outdoor air and a refrigerant; a first refrigerant distribution device having branch pipes connected to a plurality of refrigerant tubes, respectively, of an upper part among the plurality of refrigerant tubes; a second refrigerant distribution device having branch pipes connected to a plurality of refrigerant tubes, respectively, of a lower part among the plurality of refrigerant tubes; and a communication pipe for communicating one of the branch pipes of the first refrigerant distribution device and one of the branch pipes of the second refrigerant distribution device. Therefore, when performing divisional defrost of an upper part and divisional defrost of a lower part of the outdoor heat exchange unit, the remaining frost of a central portion of the outdoor heat exchange unit can be also removed.

13 Claims, 9 Drawing Sheets

AIR CONDITIONER

This application claims the benefit of the Korean Patent Application No. 10-2009-0076837, filed on Aug. 19, 2009, which is hereby incorporated by reference in its entirety.

BACKGROUND OF THE INVENTION

1. Field of the Invention

The present invention relates to an air conditioner, and more particularly, to an air conditioner for defrosting an outdoor heat exchanger using hot gas.

2. Description of the Related Art

In general, an air conditioner is an apparatus for cooling or heating indoor using a refrigeration cycle including a compressor, an outdoor heat exchanger, an expansion device, and an indoor heat exchanger. That is, the air conditioner can be formed as a cooler for cooling indoor or as a heater for heating indoor. The air conditioner can be formed as an air conditioner for both cooling and heating for cooling or heating indoor.

When the air conditioner is formed as an air conditioner for both cooling and heating, the air conditioner includes a 4-way valve for changing a flow path of a refrigerant compressed in a compressor according to a cooling operation and a heating operation. That is, when a cooling operation is performed, a refrigerant compressed in the compressor is flowed to an outdoor heat exchanger by passing through a 4-way valve, and the outdoor heat exchanger functions as a condenser. A refrigerant condensed in the outdoor heat exchanger is expanded in the expansion device and is injected into an indoor heat exchanger. In this case, the indoor heat exchanger functions as an evaporator, and a refrigerant evaporated in the indoor heat exchanger is injected into the compressor by passing through again the 4-way valve.

When a heating operation is performed, a refrigerant compressed in the compressor flows to the indoor heat exchanger by passing through the 4-way valve, and the indoor heat exchanger functions as a condenser. A refrigerant condensed in the indoor heat exchanger is expanded in the expansion device and is injected into the outdoor heat exchanger. In this case, the outdoor heat exchanger functions as an evaporator, and a refrigerant evaporated in the outdoor heat exchanger is injected into the compressor by passing through again the 4-way valve.

In such an air conditioner, water is generated on a surface of a heat exchanger acting as an evaporator while operating, and water is generated on the surface of an indoor heat exchanger in a case of a cooling operation and water is generated on a surface of an outdoor heat exchanger in a case of a heating operation. In this case, upon performing a heating operation, when condensed water generated on a surface of the outdoor heat exchanger is frozen, a smooth flow and heat exchange of outdoor air are disturbed, thereby deteriorating heating performance.

Therefore, in order to remove frosted condensate water, when a heating operation is stopped while performing a heating operation and a refrigerating cycle is operated in an inverse cycle (i.e., a cooling operation), a refrigerant of a high temperature and a high pressure passes through the outdoor heat exchanger and frost on a surface of the outdoor heat exchanger is melted by heat of the refrigerant. However, when a defrost operation is performed by the inverse cycle, indoor heating should be stopped.

SUMMARY OF THE INVENTION

The present invention has been made in an effort to solve the above problems, and the present invention provides an air conditioner that can effectively perform division defrost of an outdoor heat exchanger and effectively remove the remaining frost of a central part of the outdoor heat exchanger.

According to an aspect of the present invention, there is provided an air conditioner including: an outdoor heat exchange unit in which a plurality of refrigerant tubes are disposed to be separated in a plurality of columns in a vertical direction to exchange heat of outdoor air and a refrigerant; a first refrigerant distribution device having branch pipes connected to a plurality of refrigerant tubes, respectively, of an upper part among the plurality of refrigerant tubes; a second refrigerant distribution device having branch pipes connected to a plurality of refrigerant tubes, respectively, of a lower part among the plurality of refrigerant tubes; and a communication pipe for communicating one of the branch pipes of the first refrigerant distribution device and one of the branch pipes of the second refrigerant distribution device.

The communication pipe may connect a lowest branch pipe of the branch pipes of the first refrigerant distribution device and an uppermost branch pipe of the branch pipes of the second refrigerant distribution device.

The air conditioner may further include a third refrigerant distribution device connected to all of the plurality of refrigerant tubes using the branch pipe.

The air conditioner may further include: compressors for compressing a refrigerant; hot gas pipes for connecting outlets of the compressors and inlets of the first and second refrigerant distribution devices, respectively; a first hot gas valve for adjusting hot gas flowing from the outlet of the compressor to the first refrigerant distribution device through the hot gas pipe; and a second hot gas valve for adjusting hot gas flowing from the outlet of the compressor to the second refrigerant distribution device through the hot gas pipe.

The hot gas pipes may connect the outlets of the compressors and the inlet of the first and second refrigerant distribution devices based on when performing a heating operation of the air conditioner.

The air conditioner may further include: a first expansion valve for intercepting injection of a refrigerant to the first refrigerant distribution device when hot gas is injected through the first hot gas valve; and a second expansion valve for intercepting injection of a refrigerant to the second refrigerant distribution device when hot gas is injected through the second hot gas valve.

The hot gas pipes may include: a sharing hot gas pipe connected to a cooling/heating switching valve connection pipe between a cooling/heating switching valve for switching cooling/heating and the compressors; a first refrigerant distribution device connection pipe for connecting the sharing hot gas pipe and the inlet of the first refrigerant distribution device; and a second refrigerant distribution device connection pipe for connecting the sharing hot gas pipe and the inlet of the second refrigerant distribution device.

The first expansion valve may be installed in the first refrigerant distribution device connection pipe, and the second expansion valve may be installed in the second refrigerant distribution device connection pipe.

According to another aspect of the present invention, there is provided an air conditioner including: an outdoor heat exchange unit in which a plurality of refrigerant tubes are disposed to be separated in a plurality of columns in a vertical direction to exchange heat of outdoor air and a refrigerant; a first refrigerant distribution device having branch pipes connected to refrigerant tubes, respectively, other than a lowest refrigerant tube of a plurality of refrigerant tubes of an upper part of the plurality of refrigerant tubes and having a branch pipe connected to an uppermost refrigerant tube of a plurality of refrigerant tubes of a lower part of the plurality of refrigerant tubes; and a second refrigerant distribution device having branch pipes connected to refrigerant tubes, respectively, other than an uppermost refrigerant tube of a plurality of refrigerant tubes of a lower part of the plurality of refrigerant tubes and having a branch pipe connected to a lowest refrigerant tube of a plurality of refrigerant tubes of an upper part of the plurality of refrigerant tubes.

The air conditioner may further include a third refrigerant distribution device connected to all of the plurality of refrigerant tubes using the branch pipe.

The air conditioner may further include: compressors for compressing a refrigerant; hot gas pipes for connecting outlets of the compressor and inlets of the first and second refrigerant distribution devices, respectively; a first hot gas valve for adjusting hot gas flowing from the outlet of the compressor to the first refrigerant distribution device through the hot gas pipe; and a second hot gas valve for adjusting hot gas flowing from the outlet of the compressor to the second refrigerant distribution device through the hot gas pipe.

The hot gas pipes may connect the outlets of the compressors and the inlets of the first and second refrigerant distribution devices based on when performing a heating operation of the air conditioner.

The air conditioner may further include: a first expansion valve for intercepting injection of a refrigerant to the first refrigerant distribution device when hot gas is injected through the first hot gas valve; and a second expansion valve for intercepting injection of a refrigerant to the second refrigerant distribution device when hot gas is injected through the second hot gas valve.

The hot gas pipes may include: a sharing hot gas pipe connected to a cooling/heating switching valve connection pipe between a cooling/heating switching valve for switching cooling/heating and the compressors; a first refrigerant distribution device connection pipe for connecting the sharing hot gas pipe and the inlet of the first refrigerant distribution device; and a second refrigerant distribution device connection pipe for connecting the sharing hot gas pipe and the inlet of the second refrigerant distribution device.

The first expansion valve may be installed in the first refrigerant distribution device connection pipe, and the second expansion valve may be installed in the second refrigerant distribution device connection pipe.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF THE PREFERRED EMBODIMENT

Hereinafter, exemplary embodiments according to the present invention will be described in detail with reference to the accompanying drawings.

Figure 1:
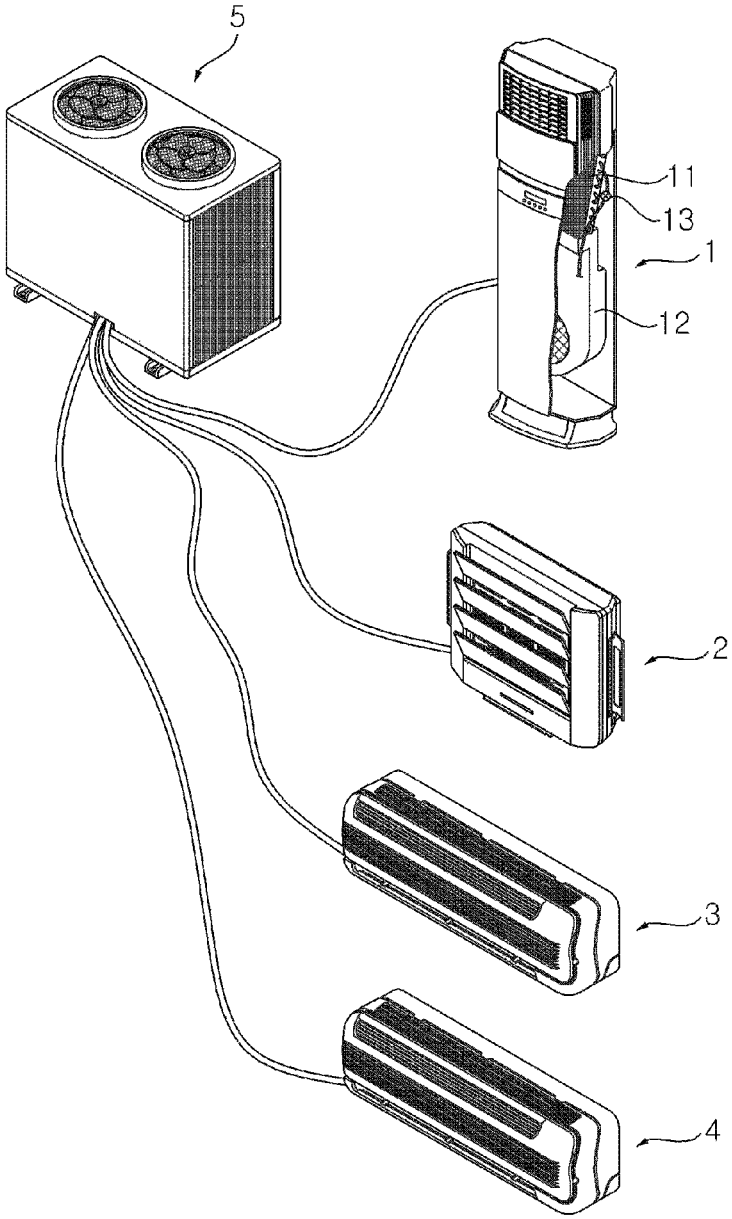
FIG. 1 is a perspective view illustrating an air conditioner according to an exemplary embodiment of the present invention.

FIG. 1 is a perspective view illustrating an air conditioner according to an exemplary embodiment of the present invention.

As shown in FIG. 1, the air conditioner according to the present exemplary embodiment includes a plurality of indoor devices 1 to 4 and an outdoor device 5 connected to the plurality of indoor devices 1 to 4 and is formed as a multi-type heat pump air conditioner for selectively cooling and heating.

In the plurality of indoor devices 1 to 4, a liquid pipe through which a liquid refrigerant passes and a gas pipe through which a gas refrigerant passes are connected in parallel.

Each of the plurality of indoor devices 1 to 4 includes an indoor heat exchanger 11 for cooling or heating indoor air while a refrigerant exchanges heat with the indoor air, an indoor ventilator 12 for inhaling indoor air into the indoor devices 1 to 4, exchanging heat with the indoor heat exchanger 11, and discharging the indoor air to the outside of the indoor devices 1 to 4, and an indoor expansion device 13 for expanding a refrigerant flowed toward the indoor heat exchanger 11.

The indoor expansion device 13 is formed with an electronic expansion valve such as LEV or EEV that can adjust expansion of a refrigerant.

Hereinafter, the outdoor device 5 is described in detail.

Figure 2:
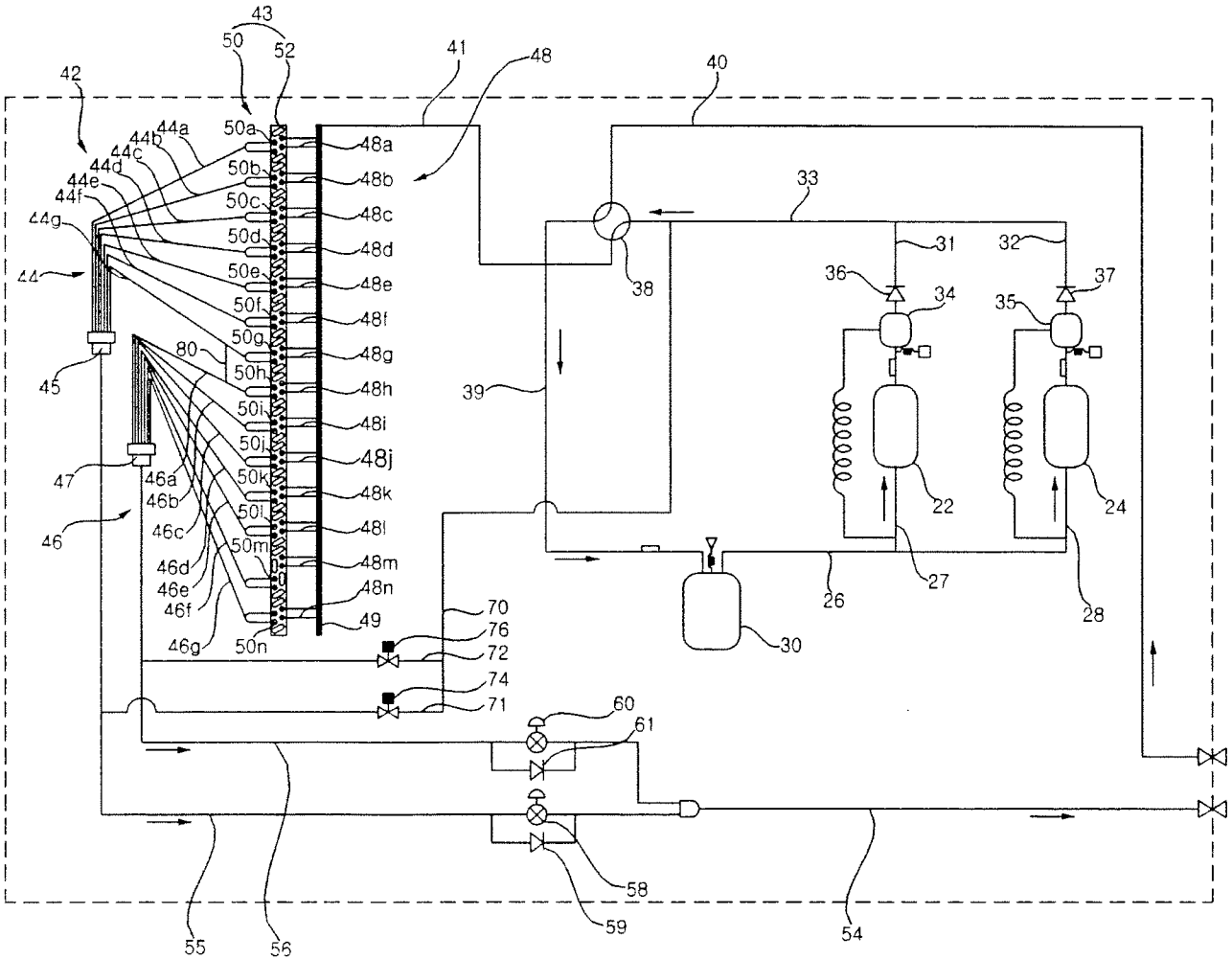
FIG. 2 is a schematic diagram illustrating a refrigerant flow of an outdoor device when performing a cooling operation of an air conditioner according to an exemplary embodiment of the present invention.
Figure 3:
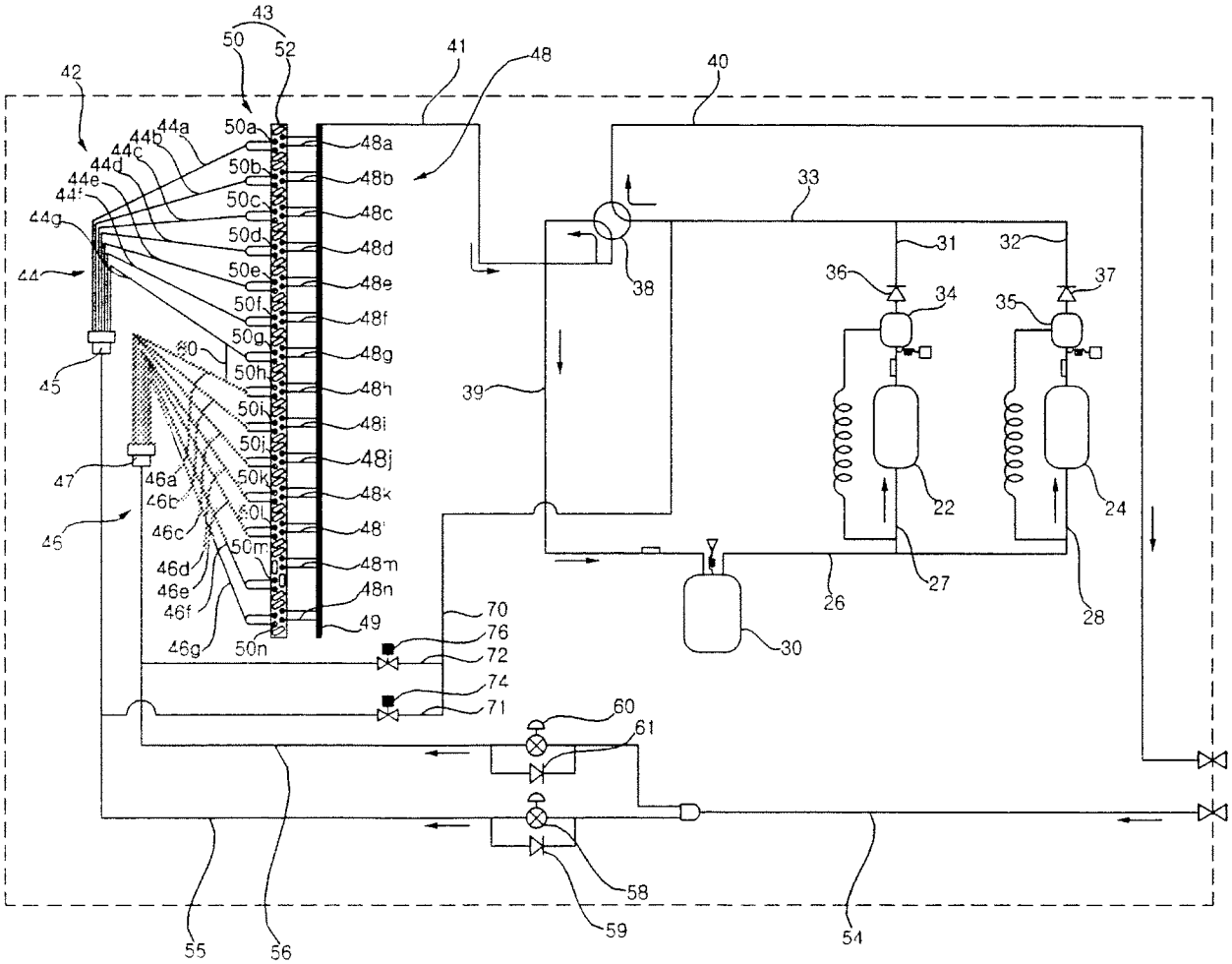
FIG. 3 is a schematic diagram illustrating a refrigerant flow of an outdoor device when performing a heating operation of an air conditioner according to an exemplary embodiment of the present invention.
Figure 4:
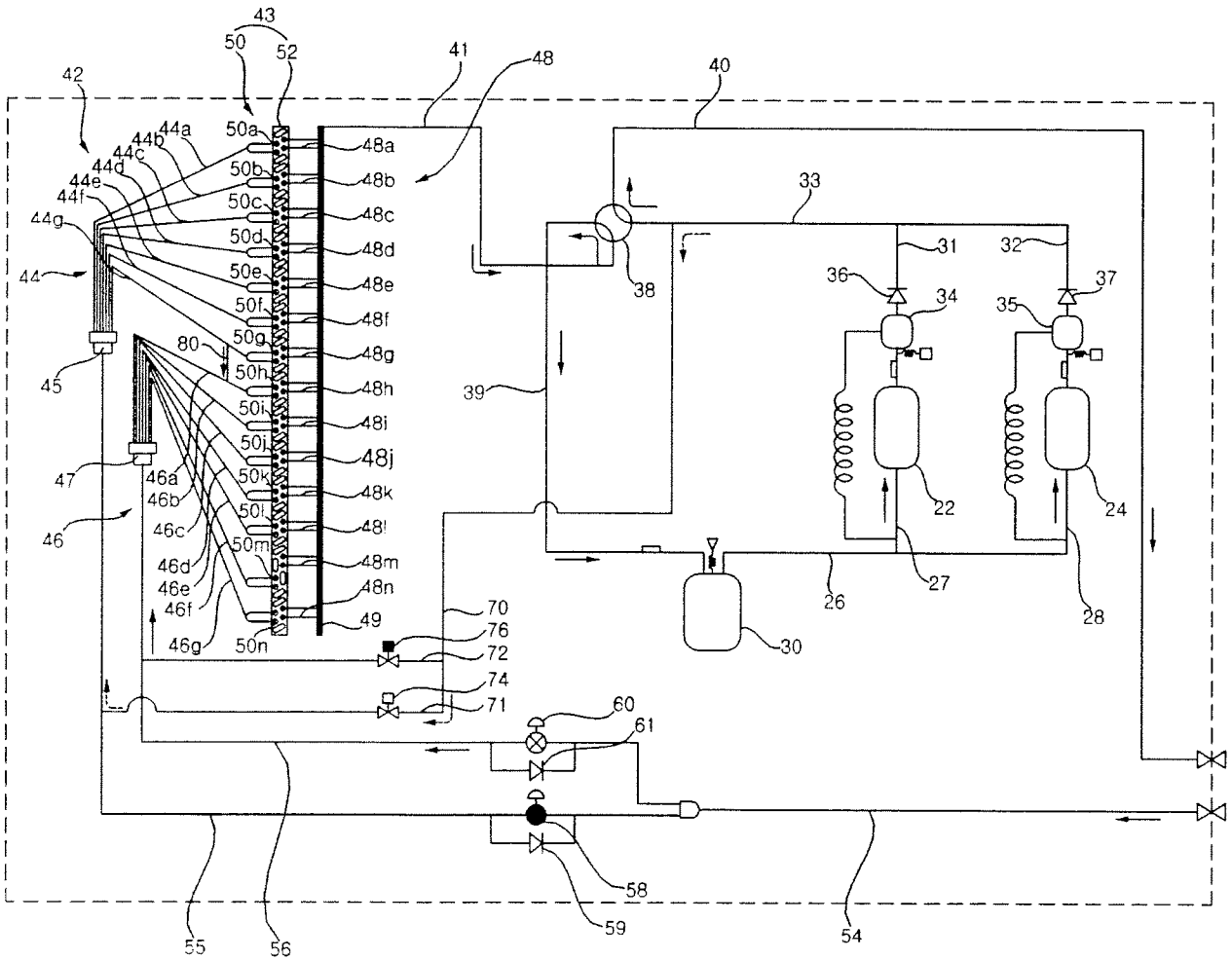
FIG. 4 is a schematic diagram illustrating a refrigerant flow of an outdoor device when defrosting an upper part of an outdoor heat exchanger of an air conditioner according to an exemplary embodiment of the present invention.
Figure 5:
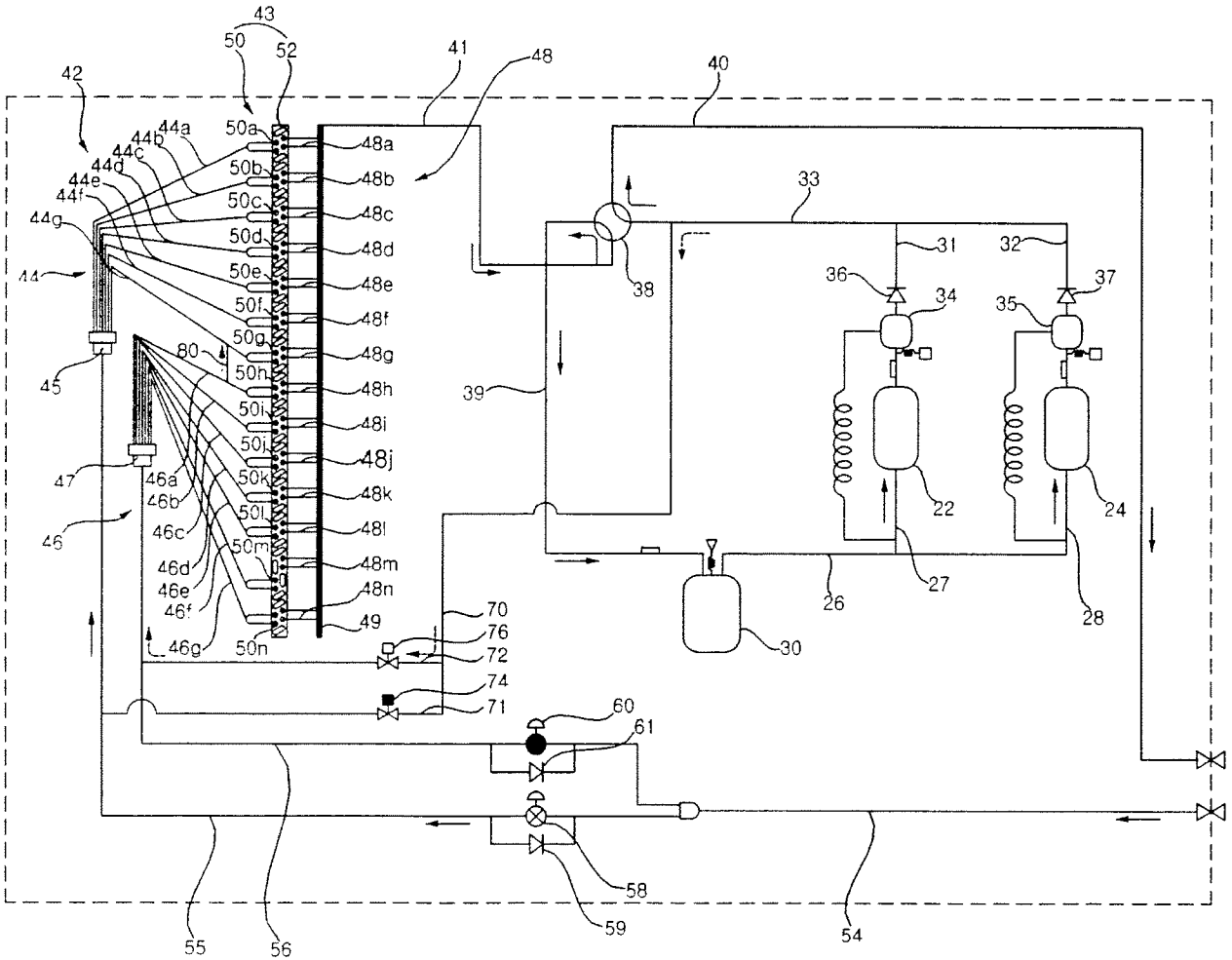
FIG. 5 is a schematic diagram illustrating a refrigerant flow of an outdoor device when defrosting a lower part of an outdoor heat exchanger of an air conditioner according to an exemplary embodiment of the present invention.

FIG. 2 is a schematic diagram illustrating a refrigerant flow of an outdoor device when performing a cooling operation of an air conditioner according to an exemplary embodiment of the present invention, FIG. 3 is a schematic diagram illustrating a refrigerant flow of an outdoor device when performing a heating operation of an air conditioner according to an exemplary embodiment of the present invention, FIG. 4 is a schematic diagram illustrating a refrigerant flow of an outdoor device when performing defrost in an upper part/evaporation in a lower part in an outdoor heat exchanger of an air conditioner according to an exemplary embodiment of the present invention, and FIG. 5 is a schematic diagram illustrating a refrigerant flow of an outdoor device when performing defrost in a lower part /evaporation in an upper part in an outdoor heat exchanger of an air conditioner according to an exemplary embodiment of the present invention.

The air conditioner according to the present exemplary embodiment includes compressors 22 and 24, a cooling/heating switching valve 38, an outdoor heat exchanger 42, outdoor expansion devices 58 and 60, hot gas pipes 70, 71, and 72, and hot gas valves 74 and 76.

The compressors 22 and 24 compress a refrigerant, are provided in plural, and in the compressors 22 and 24, refrigerant flow paths are connected in parallel.

One of the compressors 22 and 24 is formed as a capacity variable compressor 22 such as an inverter compressor and the other one is formed as a constant speed compressor 24.

In the compressors 22 and 24, inhalation pipes 26, 27, and 28 are connected to an accumulator 30, and the inhalation pipes 26, 27, and 28 include an accumulator connection pipe 26 connected to the accumulator 30 and compressor inhalation pipes 27 and 28 for connecting the accumulator connection pipe 26 and the inhalation side of the compressors 22 and 24.

In the compressors 22 and 24, discharge pipes 31, 32, and 33 are connected to one cooling/heating switching valve 38, and the discharge pipes 31, 32, and 33 include compressor discharge pipes 31 and 32 connected to the discharge side of the compressors 22 and 24 and a cooling/heating switching valve connection pipe 33 for connecting the compressor discharge pipes 31 and 32 and the cooling/heating switching valve 38.

In the compressor discharge pipes 31 and 32, oil separators 34 and 35 for separating oil from a refrigerant and oil discharged from the compressors 22 and 24 and for recovering the oil to the inhalation pipes 26, 27, and 28 and check valves 36 and 37 for preventing flowing backward of a refrigerant passing through the oil separators 34 and 35 are installed.

The cooling/heating switching valve 38 guides a refrigerant compressed in the compressors 22 and 24 to the outdoor heat exchanger 42 and guides a refrigerant flowed in the indoor devices 1 to 4 to the accumulator 30 upon performing a cooling operation, and guides a refrigerant compressed in the compressors 22 and 24 to the indoor devices 1 to 4 and guides a refrigerant flowed in the outdoor heat exchanger 42 to the accumulator 30 upon performing a heating operation and is connected to the compressors 22 and 24 using the discharge pipes 31, 32, and 33, is connected to the accumulator 30 using an accumulator connection pipe 39, is connected to the indoor heat exchanger 11 using an indoor heat exchanger connection pipe 40, and is connected to the outdoor heat exchanger 42 using an outdoor heat exchanger connection pipe 41.

The outdoor heat exchanger 42 is an evaporator/condenser for evaporating a refrigerant while exchanging heat of the refrigerant and outdoor air upon performing a cooling operation and for condensing a refrigerant while exchanging heat of the refrigerant and outdoor air upon performing a heating operation.

The outdoor heat exchanger 42 includes an outdoor heat exchange unit 43 in which a refrigerant exchanges heat, first and second refrigerant distribution devices 44 and 46 for distributing a refrigerant to the outdoor heat exchange unit 43 upon performing a heating operation and for guiding to collect a refrigerant passing through the outdoor heat exchange unit 43 upon performing a cooling operation, and a third refrigerant distribution device 48 for guiding to collect a refrigerant passing through the outdoor heat exchange unit 43 upon performing a heating operation and for distributing a refrigerant to the outdoor heat exchange unit 43 upon performing a cooling operation.

The outdoor heat exchanger 42 is formed to inject a refrigerant of different temperatures into an upper part and a lower part of the outdoor heat exchange unit 43 by the first and second refrigerant distribution devices 44 and 46 upon performing a heating operation and is formed to inject a refrigerant of the same temperature into an upper part and a lower part of the outdoor heat exchange unit 43 by the third refrigerant distribution device 48 upon performing a cooling operation.

In the outdoor heat exchange unit 43, a plurality of refrigerant tubes 50 are disposed to be separated in a plurality of columns in a vertical direction to exchange heat of a refrigerant and outdoor air, and a plurality of electric heating pins 52 are connected to the plurality of refrigerant tubes 50.

In the first refrigerant distribution device 44, branch pipes 44*a*, 44*b*, 44*c*, 44*d*, 44*e*, 44*f*, and 44*g* are connected to a plurality of refrigerant tubes 50*a*, 50*b*, 50*c*, 50*d*, 50*e*, 50*f*, and 50*g* of an upper part of the plurality of refrigerant tubes 50.

The first refrigerant distribution device 44 further includes a first distribution device body 45 to which the plurality of branch pipes 44*a*, 44*b*, 44*c*, 44*d*, 44*e*, 44*f*, and 44*g* of the first refrigerant distribution device 44 are connected.

In the second refrigerant distribution device 46, branch pipes 46*a*, 46*b*, 46*c*, 46*d*, 46*e*, 46*f*, and 46*g* are connected to a plurality of refrigerant tubes 50*h*, 50*i*, 50*j*, 50*k*, 50*l*, 50*m*, and 50*n*, respectively, of a lower part of the plurality of refrigerant tubes 50.

The second refrigerant distribution device 46 further includes a second distribution device body 47 to which the plurality of branch pipes 46*a*, 46*b*, 46*c*, 46*d*, 46*e*, 46*f*, and 46*g* of the second refrigerant distribution device 46 are connected.

In the first distribution device body 45 and the second distribution device body 47, refrigerant pipes 54, 55, and 56 are connected in parallel so that a refrigerant flowed in the plurality of refrigerant tubes 50 of the outdoor heat exchange unit 43 flows to the indoor devices 1 to 4 upon performing a cooling operation and a refrigerant flowed in the indoor devices 1 to 4 flows to the plurality of refrigerant tubes 50 of the outdoor heat exchange unit 43 upon performing a heating operation.

The refrigerant pipes 54, 55, and 56 include an indoor device connection pipe 54 connected to the indoor devices 1 to 4, a first distribution device body connection pipe 55 connected to the indoor device connection pipe 54 and the first distribution device body 45, and a second distribution device body connection pipe 56 connected to the indoor device connection pipe 54 and the second distribution device body 47.

In the third refrigerant distribution device 48, all of the plurality of refrigerant tubes 50*a*, 50*b*, 50*c*, 50*d*, 50*e*, 50*f*, and 50*g* of an upper part of the plurality of refrigerant tubes 50 and the plurality of refrigerant tubes 50*h*, 50*i*, 50*j*, 50*k*, 50*l*, 50*m*, and 50*n* of a lower part thereof and branch pipes 48*a*, 48*b*, 48*c*, 48*d*, 48*e*, 48*f*, 48*g*, 48*h*, 48*i*, 48*j*, 48*k*, 48*l*, 48*m*, and 48*n* are connected, respectively.

The third refrigerant distribution device 48 further includes a third distribution device body 49 to which the plurality of branch pipes 48*a*, 48*b*, 48*c*, 48*d*, 48*e*, 48*f*, 48*g*, 48*h*, 48*i*, 48*j*, 48*k*, 48*l*, 48*m*, and 48*n* of the third refrigerant distribution device 48 are connected.

The third distribution device body 49 is connected to the outdoor heat exchanger connection pipe 41 so that a refrigerant flowed from the cooling/heating switching valve 38 flows to the plurality of refrigerant tubes 50 of the outdoor heat exchange unit 43 upon performing a cooling operation and a refrigerant flowed from the plurality of refrigerant tubes 50 of the outdoor heat exchange unit 43 flows to the cooling/heating switching valve 38 upon performing a heating operation.

The outdoor expansion devices 58 and 60 include a first expansion valve 58 for expanding a refrigerant flowing toward the first refrigerant distribution device 44 or for intercepting injection of a refrigerant to the first refrigerant distribution device 44 and a second expansion valve 60 for expanding a refrigerant flowing toward the second refrigerant distribution device 46 or for intercepting injection of a refrigerant to the second refrigerant distribution device 46.

The first expansion valve 58 is installed in the first distribution device body connection pipe 55.

When hot gas is injected through a first hot gas valve (not shown) to be described later upon defrosting an upper part of the outdoor heat exchanger 42, the first expansion valve 58 is controlled so that a refrigerant injected from the indoor devices 1 to 4 does not flow to the first refrigerant distribution device 44.

In the first expansion valve 58, upon performing a cooling operation, a first expanding valve 59 is connected parallel to the first expansion valve 58 so that a refrigerant flowed from the outdoor heat exchanger 42 bypasses the first expansion valve 58.

The second expansion valve 60 is installed in the second distribution device body connection pipe 56.

When hot gas is injected through a second hot gas valve (not shown) to be described later upon defrosting a lower part of the outdoor heat exchanger 42, the second expansion valve 60 is controlled so that a refrigerant injected from the indoor devices 1 to 4 does not flow to the second refrigerant distribution device 46.

In the second expansion valve 60, upon performing a cooling operation, a second expanding valve 61 is connected parallel to the second expansion valve 60 so that a refrigerant flowed from the outdoor heat exchanger 42 bypasses the second expansion valve 60.

Hot gas pipes 70, 71, and 72 are installed to connect an outlet of the compressors 22 and 24 and inlets of the first and second refrigerant distribution devices 44 and 46 based on when performing a heating operation of the air conditioner.

The hot gas pipes 70, 71, and 72 include a sharing hot gas pipe 70 connected to a refrigerant pipe, particularly the cooling/heating switching valve connection pipe 33, between the compressors 22 and 24 and the cooling/heating switching valve 38, a first refrigerant distribution device connection pipe 71 for connecting the sharing hot gas pipe 70 and an inlet of the first refrigerant distribution device 44, and a second refrigerant distribution device connection pipe 72 for connecting the sharing hot gas pipe 70 and an inlet of the second refrigerant distribution device 46.

In the hot gas pipes 70, 71, and 72, a first hot gas valve 74 for adjusting hot gas flowing from an outlet of the compressors 22 and 24 to the first refrigerant distribution device 44 through the hot gas pipes 70 and 71 and a second hot gas valve 76 for adjusting hot gas flowing from an outlet of the compressors 22 and 24 to the second refrigerant distribution device 46 through the hot gas pipes 70 and 72 are installed.

The first hot gas valve 74 is installed in the first refrigerant distribution device connection pipe 71. The first hot gas valve 74 is opened when defrosting an upper part of the outdoor heat exchanger 42 and is closed in a case other than when defrosting an upper part of the outdoor heat exchanger 42.

The second hot gas valve 76 is installed in the second refrigerant distribution device connection pipe 72. The second hot gas valve 76 is opened when defrosting a lower part of the outdoor heat exchanger 42 and is closed in a case other than when defrosting a lower part of the outdoor heat exchanger 42.

The air conditioner according to the present exemplary embodiment further includes a communication pipe 80 for communicating one 44*g* of the branch pipes 44*a*, 44*b*, 44*c*, 44*d*, 44*e*, 44*f*, and 44*g* of the first refrigerant distribution device 44 and one 46*a* of the branch pipes 46*a*, 46*b*, 46*c*, 46*d*, 46*e*, 46*f*, and 46*g* of the second refrigerant distribution device 46.

In the communication pipe 80, when defrosting an upper part of the outdoor heat exchanger 42, some of hot gas supplied to an upper part of the outdoor heat exchanger 43 through the first refrigerant distribution device 44 is also defrosted while being supplied to one of the plurality of refrigerant tubes 50*h*, 50*i*, 50*j*, 50*k*, 50*l*, 50*m*, and 50*n* of a lower part of the outdoor heat exchanger 42, and when defrosting a lower part of the outdoor heat exchanger 42, some of hot gas supplied to a lower part of the outdoor heat exchanger 43 through the second refrigerant distribution device 46 is also defrosted while being supplied to one of the plurality of refrigerant tubes 50*a*, 50*b*, 50*c*, 50*d*, 50*e*, 50*f*, and 50*g* of an upper part of the outdoor heat exchanger 42.

Figure 6:
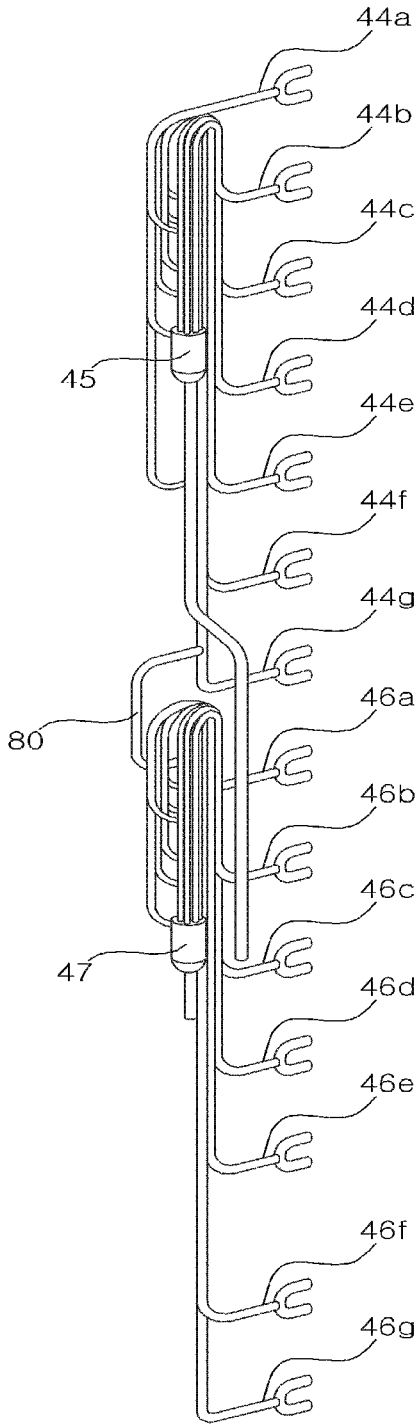
FIG. 6 is a perspective view illustrating a distribution device shown in FIG. 5.

FIG. 6 is an enlarged perspective view illustrating first and second refrigerant distribution devices shown in FIGS. 2 to 5.

When defrosting an upper part of the outdoor heat exchanger 42, in order to defrost together a central part of the outdoor heat exchanger 42, and when defrosting a lower part of the outdoor heat exchanger 42, in order to defrost together a central part of the outdoor heat exchanger 42, the communication pipe 80 is installed to connect the lowest branch pipe 44*g* of the branch pipes 44*a*, 44*b*, 44*c*, 44*d*, 44*e*, 44*f*, and 44*g* of the first refrigerant distribution device 44 and the uppermost branch pipe 46*a* of the branch pipes 46*a*, 46*b*, 46*c*, 46*d*, 46*e*, 46*f*, and 46*g* of the second refrigerant distribution device 46.

Figure 7:
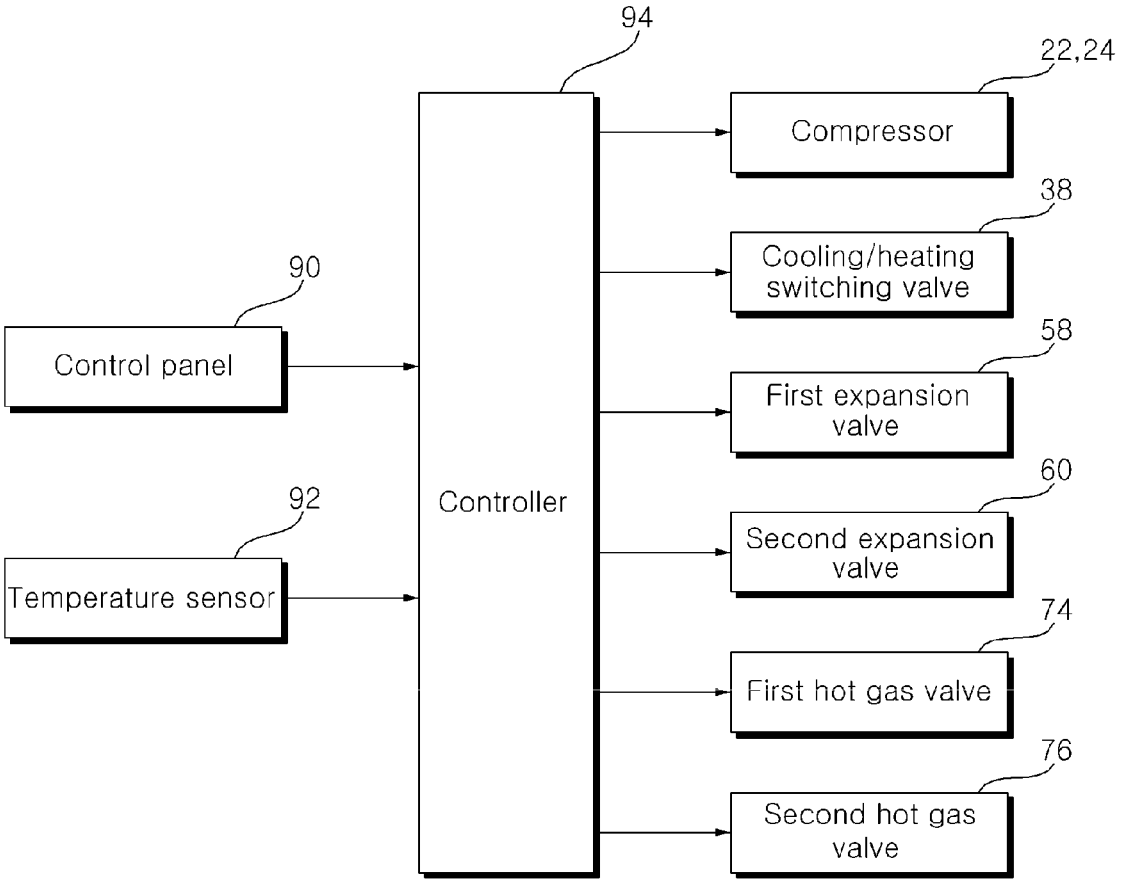
FIG. 7 is a block diagram illustrating a control process of an air conditioner according to an exemplary embodiment of the present invention.

FIG. 7 is a block diagram illustrating a control process of an air conditioner according to an exemplary embodiment of the present invention.

The air conditioner according to the present exemplary embodiment includes a control panel 90 for manipulating the air conditioner, a temperature sensor 92 for determining a defrost condition of the outdoor heat exchanger 42, and a controller 94 for controlling the compressors 22 and 24 and the cooling/heating switching valve 38 according to a cooling/heating operation manipulated through the control panel 90 and for performing a heating/defrost operation according to a defrost condition such as a temperature detected in the temperature sensor 92 when performing a heating operation.

Here, the temperature sensor 92 may be formed with an upper temperature sensor installed in an upper part of the outdoor heat exchanger 42 and a lower temperature sensor installed in a lower part of the outdoor heat exchanger 42 and may be formed with one temperature sensor installed in one of an upper part and a lower part of the outdoor heat exchanger 42.

The controller 94 determines whether frost is generated according to a temperature value detected in the upper temperature sensor and the lower temperature sensor, determines whether defrost is complete, and determines whether frost is generated and determines whether defrost is complete according to a temperature value detected in one temperature sensor.

The controller 94 may determine whether frost is performed in consideration of both a temperature value detected in the temperature sensor 92 and a sum time period of a heating operation, may determine whether frost is performed in consideration of only one of a temperature value detected in the temperature sensor 92 and a sum time period of a heating operation, and may use various defrost conditions.

The controller 94 controls a mode of the cooling/heating switching valve 38 to a cooling mode upon performing a cooling operation and controls a mode of the first and second hot gas valves 74 and 76 to a close mode.

The controller 94 controls a mode of the cooling/heating switching valve 38 to a heating mode upon performing a heating operation and controls a mode of the first and second hot gas valves 74 and 76 to a close mode.

When a defrost condition is obtained while performing a heating operation, the controller 94 sustains the cooling/heating switching valve 38 in a present state, which is a heating mode, and controls the first expansion valve 58 to be in a close mode while controlling the first hot gas valve 74 to be in an opening mode, and if a predetermined time period has elapsed or if a temperature detected in the temperature sensor 92 rises a defrost release temperature or more of an upper part, the controller 94 controls the first expansion valve 58 to be in an opening mode while controlling the first hot gas valve 74 to be in a close mode and controls the second expansion valve 76 to be in a close mode while controlling the second expansion valve 76 to be in an opening mode.

Hereinafter, a heating/defrost operation and when performing a cooling operation and a heating operation will be described in detail.

First, when performing a cooling operation, the compressors 22 and 24 are driven, the cooling/heating switching valve 38 is controlled to a cooling mode, the first and second hot gas valves 74 and 76 are controlled to a close mode, and a refrigerant compressed in the compressors 22 and 24 flows to the cooling/heating switching valve 38 instead of flowing to the first and second hot gas pipes 70, 71, and 72, as shown in FIG. 2.

A refrigerant flowed to the cooling/heating switching valve 38 is distributed and condensed to all of the plurality of refrigerant tubes 50 through the third refrigerant distribution device 48, and a refrigerant condensed while passing through the plurality of refrigerant tubes 50*a*, 50*b*, 50*c*, 50*d*, 50*e*, 50*f*, and 50*g* of an upper part of the plurality of refrigerant tubes 50 is flowed to the first refrigerant distribution device 44, and a refrigerant condensed while passing through the plurality of refrigerant tubes 50*h*, 50*i*, 50*j*, 50*k*, 50*l*, 50*m*, and 50*n* of a lower part of the plurality of refrigerant tubes 50 is flowed to the second refrigerant distribution device 46.

As described above, a refrigerant flowed to the first refrigerant distribution device 44 and the second refrigerant distribution device 46 is gathered in the refrigerant pipes 54, 55, and 56 and is flowed to the indoor devices 1 to 4.

The refrigerant flowed to the indoor devices 1 to 4 is expanded in the indoor expansion device 13, is evaporated in the indoor heat exchanger 11, is flowed to the outdoor device 5, and is circulated to the compressors 22 and 24 after sequentially passing through the cooling/heating switching valve 38 and the accumulator 30.

Upon performing a heating operation, the compressors 22 and 24 are driven, the cooling/heating switching valve 38 is controlled to a heating mode, the first and second hot gas valves 74 and 76 are controlled to a close mode, and a refrigerant compressed in the compressors 22 and 24 flows to the cooling/heating switching valve 38 instead of flowing to the first and second hot gas pipes 70, 71, and 72, as shown in FIG. 3.

The refrigerant flowed to the cooling/heating switching valve 38 is flowed to the indoor devices 1 to 4 to be condensed in the indoor heat exchanger 13, is moved to the outdoor device 5 to be distributed, is expanded in the first and second expansion valves 58 and 60, is condensed while passing through the plurality of refrigerant tubes 50*a*, 50*b*, 50*c*, 50*d*, 50*e*, 50*f*, and 50*g* of an upper part of the plurality of refrigerant tubes 50 through the first refrigerant distribution device 44, and is condensed while passing through the plurality of refrigerant tubes 50*h*, 50*i*, 50*j*, 50*k*, 50*l*, 50*m*, and 50*n* of a lower part of the plurality of refrigerant tubes 50 through the second refrigerant distribution device 46.

The condensed refrigerant is gathered in the third refrigerant distribution device 48 and is circulated to the compressors 22 and 24 after sequentially passing through the cooling/heating switching valve 38 and the accumulator 30.

While performing a heating operation, if a defrost condition is obtained, the controller 94 controls the first expansion valve 58 to be in a close mode while controlling the first hot gas valve 74 to be in an opening mode.

When performing such a control process, as shown in FIG. 4, some of a refrigerant compressed in the compressors 22 and 24 flows to the first refrigerant distribution device 44 after passing through the hot gas pipes 70 and 71 and the first hot gas valve 74, and the remaining portion of the refrigerant is condensed while passing through the indoor devices 1 to 4 after passing through the cooling/heating switching valve 38 and flows to the second refrigerant distribution device 46 after being expanded while passing through the second expansion valve 60, as in a heating operation.

In this case, most of hot gas flowed to the first refrigerant distribution device 44 flows to the plurality of refrigerant tubes 50*a*, 50*b*, 50*c*, 50*d*, 50*e*, 50*f*, and 50*g* of an upper part of the plurality of refrigerant tubes 50 through the branch pipes 44*a*, 44*b*, 44*c*, 44*d*, 44*e*, 44*f*, and 44*g* of the first refrigerant distribution device 44, and some of hot gas flows to the uppermost branch pipe 46*a* of the second refrigerant distribution device 46 through the communication pipe 80.

The expanded refrigerant flowed to the second refrigerant distribution device 46 flows to the branch pipes 46*a*, 46*b*, 46*c*, 46*d*, 46*e*, 46*f*, and 46*g* of the second refrigerant distribution device 46, and an expanded refrigerant flowing to the uppermost branch pipe 46*a* is mixed with hot gas injected through the communication pipe 80.

When the hot gas and the expanded refrigerant flow, while a refrigerant of a high temperature flows to the plurality of refrigerant tubes 50*a*, 50*b*, 50*c*, 50*d*, 50*e*, 50*f*, and 50*g* of an upper part, defrost is performed and in refrigerant tubes 50*i*, 50*j*, 50*k*, 50*l*, 50*m*, and 50*n* other than the uppermost refrigerant tube 50*h* of the plurality of refrigerant tubes 50*h*, 50*i*, 50*j*, 50*k*, 50*l*, 50*m*, and 50*n* of a lower part, evaporation is performed while a refrigerant of a low temperature flows, while a refrigerant (mixed refrigerant of hot gas and an expanded refrigerant) of a temperature relatively higher than the plurality of refrigerant tubes 50*h*, 50*i*, 50*j*, 50*k*, 50*l*, 50*m*, and 50*n* of a lower part flows, defrost is performed.

That is, as described above, when a refrigerant flows, in the plurality of refrigerant tubes 50, the uppermost refrigerant tube 50*h* of the plurality of refrigerant tubes 50*h*, 50*i*, 50*j*, 50*k*, 50*l*, 50*m*, and 50*n* of a lower part as well as the plurality of refrigerant tubes 50*a*, 50*b*, 50*c*, 50*d*, 50*e*, 50*f*, and 50*g* of an upper part are defrosted together, and in the outdoor heat exchanger 42, while an upper part and a central part are defrosted together, a lower part functions as an evaporator.

As described above, the refrigerant passing through the plurality of refrigerant tubes 50 is gathered in the third refrigerant distribution device 48 and is circulated to the compressors 22 and 24 through the cooling/heating switching valve 38 and the accumulator 30.

As described above, when defrost of an upper part/heating of a lower part is performed during a predetermined time period, or when a temperature detected in the temperature sensor 92 rises a defrost release temperature or more of an upper part, the controller 94 controls the first expansion valve 58 to be in an opening mode while controlling the first hot gas valve 74 to be in a close mode and controls the second expansion valve 60 to be in a close mode while controlling the second hot gas valve 76 to be in an opening mode.

When performing such a control process, as shown in FIG. 5, some of a refrigerant compressed in the compressors 22 and 24 flows to the second refrigerant distribution device 46 after passing through the hot gas pipes 70 and 72 and the second hot gas valve 76, and the remaining portion is condensed while passing through the indoor devices 1 to 4 after passing through the cooling/heating switching valve 38 and flows to the first refrigerant distribution device 44 after being expanded while passing through the first expansion valve 58, as in a heating operation.

In this case, most of hot gas flowed to the second refrigerant distribution device 46 flows to the plurality of refrigerant tubes 50*h*, 50*i*, 50*j*, 50*k*, 50*l*, 50*m*, and 50*n* of a lower part of the plurality of refrigerant tubes 50 through the branch pipes 46*a*, 46*b*, 46*c*, 46*d*, 46*e*, 46*f*, and 46*g* of the second refrigerant distribution device 46, and some thereof flows to the lowest branch pipe 44*g* of the first refrigerant distribution device 44 through the communication pipe 80.

An expanded refrigerant flowed to the first refrigerant distribution device 44 flows to the branch pipes 44*a*, 44*b*, 44*c*, 44*d*, 44*e*, 44*f*, and 44*g* of the first refrigerant distribution device 44, and an expanded refrigerant flowing to the lowest branch pipe 44*g* is mixed with hot gas injected through the communication pipe 80.

When the hot gas and the expanded refrigerant flow, while a refrigerant of a high temperature flows to the plurality of refrigerant tubes 50*h*, 50*i*, 50*j*, 50*k*, 50*l*, 50*m*, and 50*n* of a lower part, defrost is performed and while a refrigerant of a low temperature flows to the refrigerant tubes 50*a*, 50*b*, 50*c*, 50*d*, 50*e*, and 50*f* other than the lowest refrigerant tube 50*g* of the plurality of refrigerant tubes 50*a*, 50*b*, 50*c*, 50*d*, 50*e*, 50*f*, and 50*g* of an upper part, evaporation is performed, and defrost is performed while a refrigerant (mixed refrigerant of hot gas and an expanded refrigerant) of a relatively higher temperature than that of the refrigerant tubes 50*a*, 50*b*, 50*c*, 50*d*, 50*e*, and 50*f* of the upper side of the lowest refrigerant tube 50*g* flows to the lowest refrigerant tube 50*g* of the plurality of refrigerant tubes 50*a*, 50*b*, 50*c*, 50*d*, 50*e*, 50*f*, and 50*g* of an upper part.

That is, as described above, when a refrigerant flows, in the plurality of refrigerant tubes 50, the lowest refrigerant tube 50*g* of the plurality of refrigerant tubes 50*a*, 50*b*, 50*c*, 50*d*, 50*e*, 50*f*, and 50*g* of an upper part as well as the plurality of refrigerant tubes 50*h*, 50*i*, 50*j*, 50*k*, 50*l*, 50*m*, and 50*n* of a lower part are defrosted together, and thus in the outdoor heat exchanger 42, while the lower part and the central part are defrosted together, an upper part functions as an evaporator.

As described above, a refrigerant passing through the plurality of refrigerant tubes 50 is gathered in the third refrigerant distribution device 48 and then is circulated to the compressors 22 and 24 through the cooling/heating switching valve 38 and the accumulator 30.

That is, as described above, when the defrost is performed, in the indoor heat exchanger 42, a central part and an upper part are defrosted together, and then a lower part is defrosted and thus the central part is effectively defrosted, and the entire indoor heat exchanger 42 is effectively defrosted.

Figure 8:
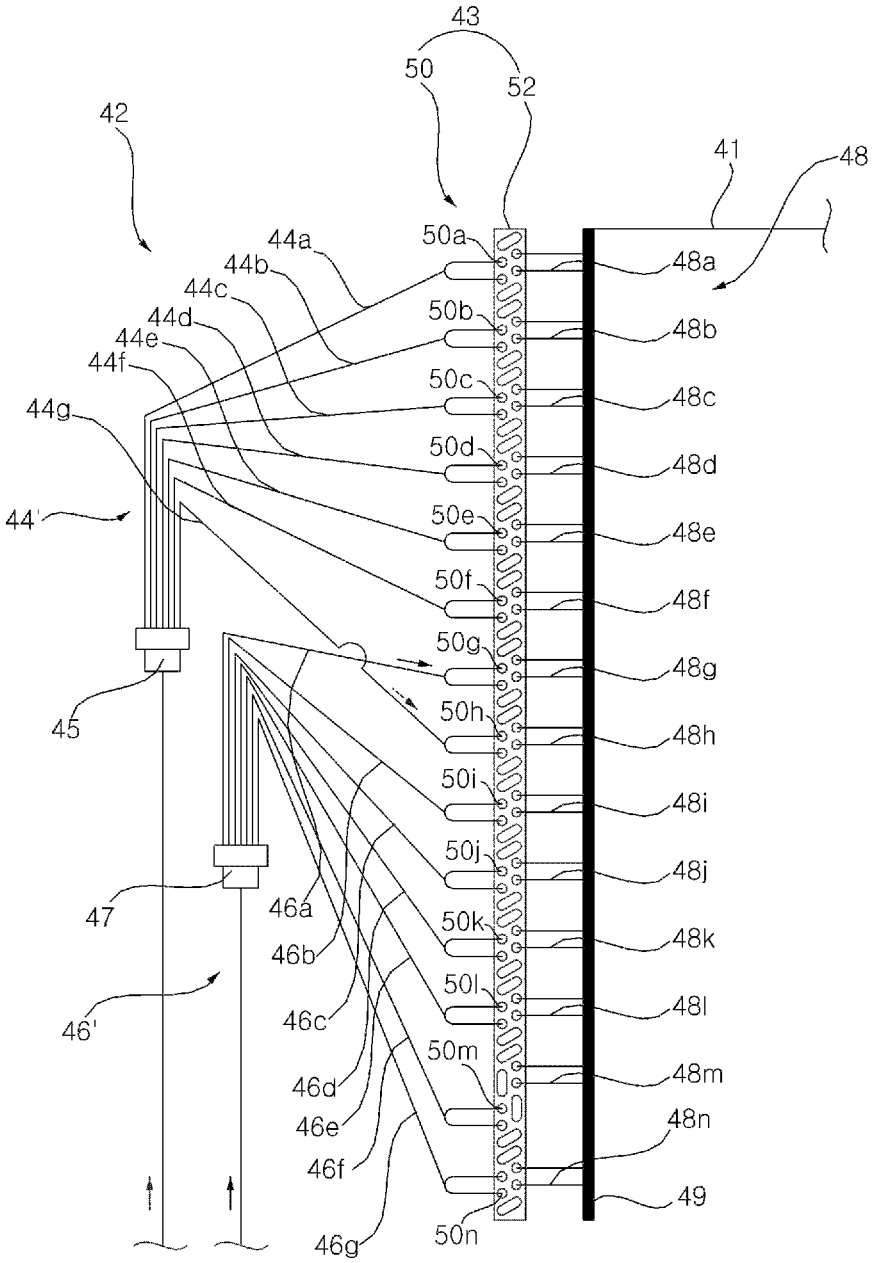
FIG. 8 is an enlarged schematic diagram illustrating a refrigerant flow of an outdoor device when performing defrost of an upper part/evaporation of a lower part of an outdoor heat exchanger of an air conditioner according to another exemplary embodiment of the present invention.
Figure 9:
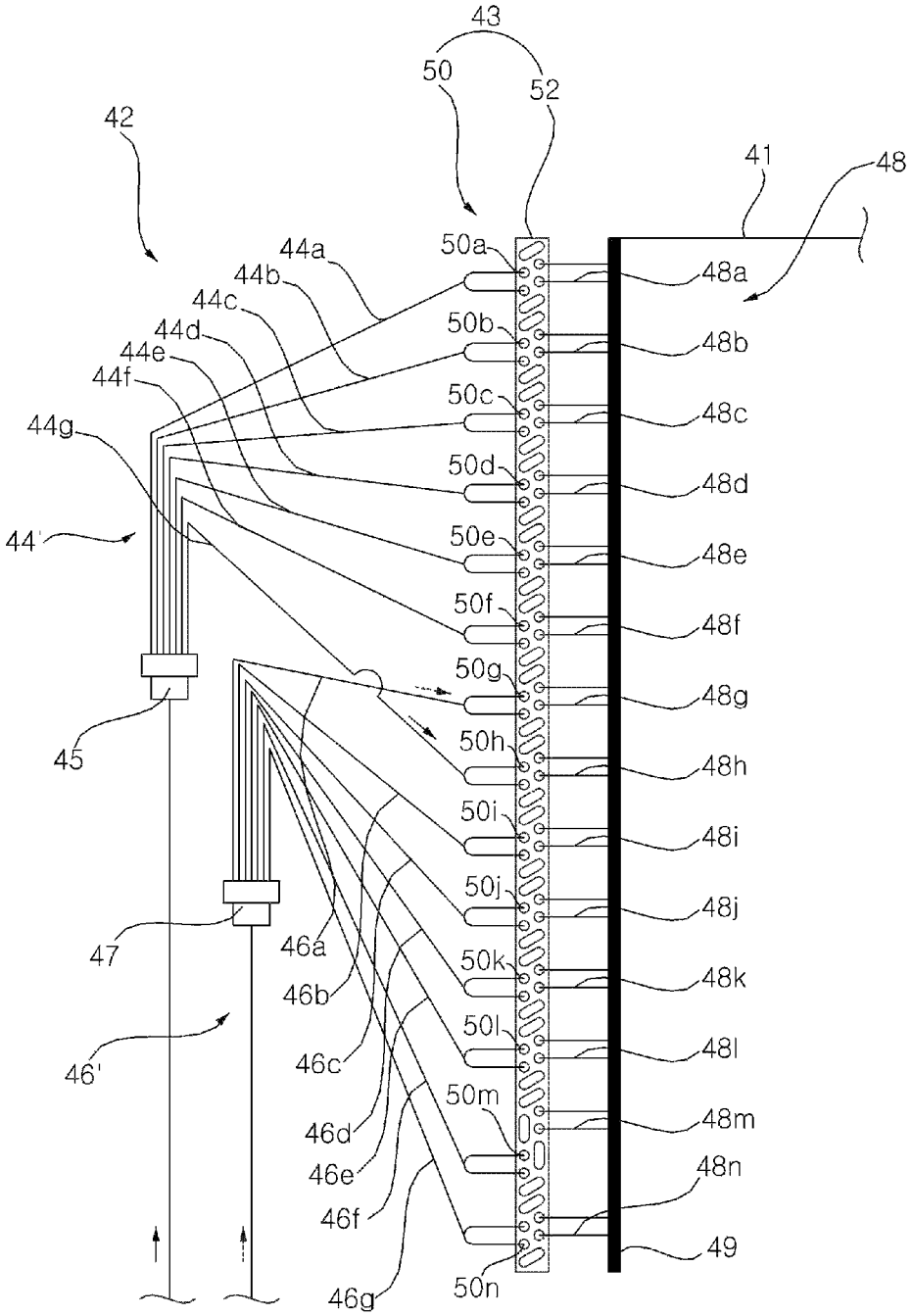
FIG. 9 is an enlarged schematic diagram illustrating a refrigerant flow of an outdoor device when performing defrost of a lower part/evaporation of an upper part of an outdoor heat exchanger of an air conditioner according to another exemplary embodiment of the present invention.

FIG. 8 is an enlarged schematic diagram illustrating a refrigerant flow of an outdoor device when performing defrost of an upper part/evaporation of a lower part of an outdoor heat exchanger of an air conditioner according to another exemplary embodiment of the present invention, and FIG. 9 is an enlarged schematic diagram illustrating a refrigerant flow of an outdoor device when performing defrost of a lower part/evaporation of an upper part of an outdoor heat exchanger of an air conditioner according to another exemplary embodiment of the present invention.

In the air conditioner according to the present exemplary embodiment, as shown in FIGS. 8 and 9, a first refrigerant distribution device 44 and a second refrigerant distribution device 46 are connected differently from those of an exemplary embodiment of the present invention, and other configurations other than the first refrigerant distribution device 44 and the second refrigerant distribution device 46 and operation thereof are equal to or similar to that of an exemplary embodiment of the present invention, and therefore a detailed description thereof will be omitted.

In the first refrigerant distribution device 44, branch pipes 44*a*, 44*b*, 44*c*, 44*d*, 44*e*, and 44*f* are connected to refrigerant tubes 50*a*, 50*b*, 50*c*, 50*d*, 50*e*, and 50*f*, respectively, other than a lowest refrigerant tube 50*g* of the plurality of refrigerant tubes 50*a*, 50*b*, 50*c*, 50*d*, 50*e*, 50*f*, and 50*g* of an upper part of a plurality of refrigerant tubes 50, and a branch pipe 44*g* is connected to an uppermost refrigerant tube 50*h* of a plurality of refrigerant tubes 50*h*, 50*i*, 50*j*, 50*k*, 50*l*, 50*m*, and 50*n* of a lower part of the plurality of refrigerant tubes 50.

In the second refrigerant distribution device 46, branch pipes 46*b*, 46*c*, 46*d*, 46*e*, 46*f*, and 46*g* are connected to refrigerant tubes 50*i*, 50*j*, 50*k*, 50*l*, 50*m*, and 50*n*, respectively, other than an uppermost refrigerant tube 50*h* of a plurality of refrigerant tubes 50*h*, 50*i*, 50*j*, 50*k*, 50*l*, 50*m*, and 50*n* of a lower part of the plurality of refrigerant tubes 50, and the branch pipe 46*a* is connected to a lowest refrigerant tube 50*g* of a plurality of refrigerant tubes 50*a*, 50*b*, 50*c*, 50*d*, 50*e*, 50*f*, and 50*g* of an upper part of the plurality of refrigerant tubes 50.

That is, the lowest branch pipe 44*g* of the first refrigerant distribution device 44 according to the present exemplary embodiment and the uppermost branch pipe 46*a* of the second refrigerant distribution device 46 are connected to deviate from each other.

In the outdoor heat exchanger 42 having the above-described configuration, when performing defrost in an upper part/evaporation in a lower part, most of hot gas flowed to the first refrigerant distribution device 44 flow to the plurality of refrigerant tubes 50*a*, 50*b*, 50*c*, 50*d*, 50*e*, and 50*f* of an upper part of the plurality refrigerant tubes 50 through the branch pipes 44*a*, 44*b*, 44*c*, 44*d*, 44*e*, and 44*f* of the first refrigerant distribution device 44 and some thereof flows to the uppermost refrigerant tube 50*h* of the plurality of refrigerant tubes 50*h*, 50*i*, 50*j*, 50*k*, 50*l*, 50*m*, and 50*n* of a lower part through the branch pipe 44*g*.

Most of an expanded refrigerant flowed to the second refrigerant distribution device 46 flows to the plurality of refrigerant tubes 50*i*, 50*j*, 50*k*, 50*l*, 50*m*, and 50*n* of a lower part of the plurality of refrigerant tubes 50 through the branch pipes 46*b*, 46*c*, 46*d*, 46*e*, 46*f*, and 46*g* of the second refrigerant distribution device 46, and some thereof flows to the lowest refrigerant tube 50*g* of the plurality of refrigerant tubes 50*a*, 50*b*, 50*c*, 50*d*, 50*e*, 50*f*, and 50*g* of an upper part through the branch pipe 46*a*.

When hot gas and an expanded refrigerant flow, the refrigerant tubes 50*a*, 50*b*, 50*c*, 50*d*, 50*e*, and 50*f* other than the lowest refrigerant tube 50*g* of the plurality of refrigerant tubes 50*a*, 50*b*, 50*c*, 50*d*, 50*e*, 50*f*, and 50*g* of an upper part and defrost is performed while a refrigerant of a high temperature flows to the uppermost refrigerant tube 50*h* of the plurality of refrigerant tubes 50*h*, 50*i*, 50*j*, 50*k*, 50*l*, 50*m*, and 50*n* of a lower part.

Evaporation is performed while a refrigerant of a lower temperature flows to the refrigerant tubes 50*i*, 50*j*, 50*k*, 50*l*, 50*m*, and 50*n* other than the uppermost refrigerant tube 50*h* of the plurality of refrigerant tubes 50*h*, 50*i*, 50*j*, 50*k*, 50*l*, 50*m*, and 50*n* of a lower part and to the lowest refrigerant tube 50*g* of the plurality of refrigerant tubes 50*a*, 50*b*, 50*c*, 50*d*, 50*e*, 50*f*, and 50*g* of an upper part.

That is, in the plurality of refrigerant tubes 50, most of the plurality of refrigerant tubes 50*a*, 50*b*, 50*c*, 50*d*, 50*e*, and 50*f* of an upper part and the uppermost refrigerant tube 50*h* of the plurality of refrigerant tubes 50*h*, 50*i*, 50*j*, 50*k*, 50*l*, 50*m*, and 50*n* of a lower part are defrosted together and while an upper part and a central part of the outdoor heat exchanger 42 are defrosted together, a lower part thereof functions as an evaporator.

On the contrary, in the outdoor heat exchanger 42 having the above-described configuration, when performing defrost in a lower part/evaporation in an upper part, while hot gas flows to the refrigerant tubes 50*i*, 50*j*, 50*k*, 50*l*, 50*m*, and 50*n* other than the uppermost refrigerant tube 50*h* of the plurality of refrigerant tubes 50*h*, 50*i*, 50*j*, 50*k*, 50*l*, 50*m*, and 50*n* of a lower part and to the lowest refrigerant tube 50*g* of the plurality of refrigerant tubes 50*a*, 50*b*, 50*c*, 50*d*, 50*e*, 50*f*, and 50*g* of an upper part, defrost is performed.

Evaporation is performed while an expanded refrigerant flows to the refrigerant tubes 50*a*, 50*b*, 50*c*, 50*d*, 50*e*, and 50*f* other than the lowest refrigerant tube 50*g* of the plurality of refrigerant tubes 50*a*, 50*b*, 50*c*, 50*d*, 50*e*, 50*f*, and 50*g* of an upper part and to the uppermost refrigerant tube 50*h* of the plurality of refrigerant tubes 50*h*, 50*i*, 50*j*, 50*k*, 50*l*, 50*m*, and 50*n* of a lower part.

That is, in the plurality of refrigerant tubes 50, most of the plurality of refrigerant tubes 50*i*, 50*j*, 50*k*, 50*l*, 50*m*, and 50*n* of a lower part and the lowest refrigerant tube 50*g* of the plurality of refrigerant tubes 50*a*, 50*b*, 50*c*, 50*d*, 50*e*, 50*f*, and 50*g* of an upper part are defrosted together, and while a lower part and a central part of the outdoor heat exchanger 42 are defrosted together, an upper part thereof functions as an evaporator.

In an air conditioner according to the present invention, when an outdoor heat exchanger performs division defrost, the remaining frost of a central part can be also removed and thus high defrost performance can be obtained.

As described above, in the air conditioner according to the present invention, each of an upper part and a lower part of an outdoor heat exchange unit can be defrosted while continuing to perform a heating operation, and hot gas flowed through a communication pipe can defrost a central part of the outdoor heat exchange unit, and upon performing division defrost of an upper part of the outdoor heat exchange unit or division defrost of a lower part thereof, and the remaining frost of a central part of the outdoor heat exchanger can also be removed.

Further, with a simple structure in which the branch pipe is connected to cross to the refrigerant tube, a central part of the outdoor heat exchange unit can be also defrosted.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air conditioner comprising:

an outdoor heat exchange unit in which a plurality of upper refrigerant tubes and a plurality of lower refrigerant tubes are disposed to be separated in a plurality of columns in a vertical direction to exchange heat of outdoor air and a refrigerant;

a first refrigerant distribution device having branch pipes connected to the plurality of upper refrigerant tubes, respectively;

a second refrigerant distribution device having branch pipes connected to the plurality of lower refrigerant tubes, respectively;

a communication pipe for communicating one of the branch pipes of the first refrigerant distribution device and one of the branch pipes of the second refrigerant distribution device; and a third refrigerant distribution device having branch pipes connected to all the plurality of upper refrigerant tubes and all the plurality of lower refrigerant tubes.

2. The air conditioner of claim 1, wherein the communication pipe connects a lowest branch pipe of the branch pipes of the first refrigerant distribution device and an uppermost branch pipe of the branch pipes of the second refrigerant distribution device.

3. The air conditioner of any one of claims 1 to 2, further comprising:

compressors for compressing a refrigerant;

hot gas pipes for connecting outlets of the compressors and inlets of the first and second refrigerant distribution devices, respectively;

a first hot gas valve for adjusting hot gas flowing from the outlet of the compressor to the first refrigerant distribution device through the hot gas pipe; and a second hot gas valve for adjusting hot gas flowing from the outlet of the compressor to the second refrigerant distribution device through the hot gas pipe.

4. The air conditioner of claim 3, wherein the hot gas pipes connect the outlets of the compressors and the inlets of the first and second refrigerant distribution devices based on when a heating operation of the air conditioner is performed.

5. The air conditioner of claim 3, further comprising:

a first expansion valve for intercepting injection of a refrigerant to the first refrigerant distribution device when hot gas is injected through the first hot gas valve; and a second expansion valve for intercepting injection of a refrigerant to the second refrigerant distribution device when hot gas is injected through the second hot gas valve.

6. The air conditioner of claim 5, wherein the hot gas pipes comprise:

a sharing hot gas pipe connected to a cooling/heating switching valve connection pipe that is between a cooling/heating switching valve for switching cooling/heating and the compressors;

a first refrigerant distribution device connection pipe for connecting the sharing hot gas pipe and the inlet of the first refrigerant distribution device; and a second refrigerant distribution device connection pipe for connecting the sharing hot gas pipe and the inlet of the second refrigerant distribution device.

7. The air conditioner of claim 6, wherein the first expansion valve is installed in a first refrigerant distribution device body connection pipe connected to an indoor device connection pipe and the inlet of the first distribution device, and the second expansion valve is installed in the second refrigerant distribution device body connection pipe connected to the indoor device connection pipe and the inlet of the second distribution device.

8. An air conditioner comprising:

an outdoor heat exchange unit in which a plurality of upper refrigerant tubes and a plurality of lower refrigerant tubes are disposed to be separated in a plurality of columns in a vertical direction to exchange heat of outdoor air and a refrigerant;

a first refrigerant distribution device having branch pipes connected to the plurality of upper refrigerant tubes, respectively, other than a lowest refrigerant tube of the plurality of upper refrigerant tubes and having a branch pipe connected to an uppermost refrigerant tube of the plurality of lower refrigerant tubes;

a second refrigerant distribution device having branch pipes connected to the plurality of lower refrigerant tubes, respectively, other than an uppermost refrigerant tube of the plurality of lower refrigerant tubes and having a branch pipe connected to a lowest refrigerant tube of the plurality of upper refrigerant tubes; and a third refrigerant distribution device having branch pipes connected to all the plurality of upper refrigerant tubes and all the plurality of lower refrigerant tubes.

9. The air conditioner of claim 8, further comprising:

compressors for compressing a refrigerant;

hot gas pipes for connecting outlets of the compressors and inlets of the first and second refrigerant distribution devices, respectively;

a first hot gas valve for adjusting hot gas flowing from the outlet of the compressor to the first refrigerant distribution device through the hot gas pipe; and a second hot gas valve for adjusting hot gas flowing from the outlet of the compressor to the second refrigerant distribution device through the hot gas pipe.

10. The air conditioner of claim 9, wherein the hot gas pipes connect the outlets of the compressors and the inlets of the first and second refrigerant distribution devices based on when a heating operation of the air conditioner is performed.

11. The air conditioner of claim 9, further comprising:

a first expansion valve for intercepting injection of a refrigerant to the first refrigerant distribution device when hot gas is injected through the first hot gas valve; and a second expansion valve for intercepting injection of a refrigerant to the second refrigerant distribution device when hot gas is injected through the second hot gas valve.

12. The air conditioner of claim 11, wherein the hot gas pipes comprise:

a sharing hot gas pipe connected to a cooling/heating switching valve connection pipe that is between a cooling/heating switching valve for switching cooling/heating and the compressors;

a first refrigerant distribution device connection pipe for connecting the sharing hot gas pipe and the inlet of the first refrigerant distribution device; and a second refrigerant distribution device connection pipe for connecting the sharing hot gas pipe and the inlet of the second refrigerant distribution device.

13. The air conditioner of claim 6, wherein the first expansion valve is installed in a first refrigerant distribution device body connection pipe connected to an indoor device connection pipe and the inlet of the first distribution device, and the second expansion valve is installed in the second refrigerant distribution device body connection pipe connected to the indoor device connection pipe and the inlet of the second distribution device.

* * * * *